US006427607B1

(12) United States Patent
Palmer

(10) Patent No.: US 6,427,607 B1
(45) Date of Patent: Aug. 6, 2002

(54) ARM AND PLATE SUPPORT SELF-FEEDING DEVICE

(76) Inventor: Edna H. Palmer, 885 Requeza St., Encinitas, CA (US) 92024

( * ) Notice: Subject to any disclaimer, the term of this patent is extended or adjusted under 35 U.S.C. 154(b) by 0 days.

(21) Appl. No.: 09/742,802

(22) Filed: Dec. 22, 2000

(51) Int. Cl.[7] ..... A47B 23/00
(52) U.S. Cl. ..... 108/43
(58) Field of Search ..... 108/145, 43, 25; 254/126; 248/421

(56) References Cited

U.S. PATENT DOCUMENTS 126,213 A * 4/1872 Ireland et al.
186,875 A * 1/1877 Price
3,410,328 A * 11/1968 Sasai
5,339,749 A * 8/1994 Hirose ..... 108/145 X
5,429,057 A * 7/1995 Buescher ..... 108/3
5,460,102 A * 10/1995 Pasmanick ..... 108/43
5,476,050 A * 12/1995 Zimmer et al. ..... 108/145
6,170,408 B1 * 1/2001 Gombrich ..... 108/145 X
RE37,239 E * 6/2001 Eisenberg ..... 108/43

* cited by examiner

*Primary Examiner*—Jose V. Chen
(74) *Attorney, Agent, or Firm*—Steven W. Webb

(57) ABSTRACT

A self-feeding device is presented which includes a height adjustment mechanism, a cut-out to place the eating hand arm, and a detachable plate support. The device is designed to be easily portable and light-weight, collapsing into a shoe-box-size shape.

1 Claim, 3 Drawing Sheets

Fig. 1
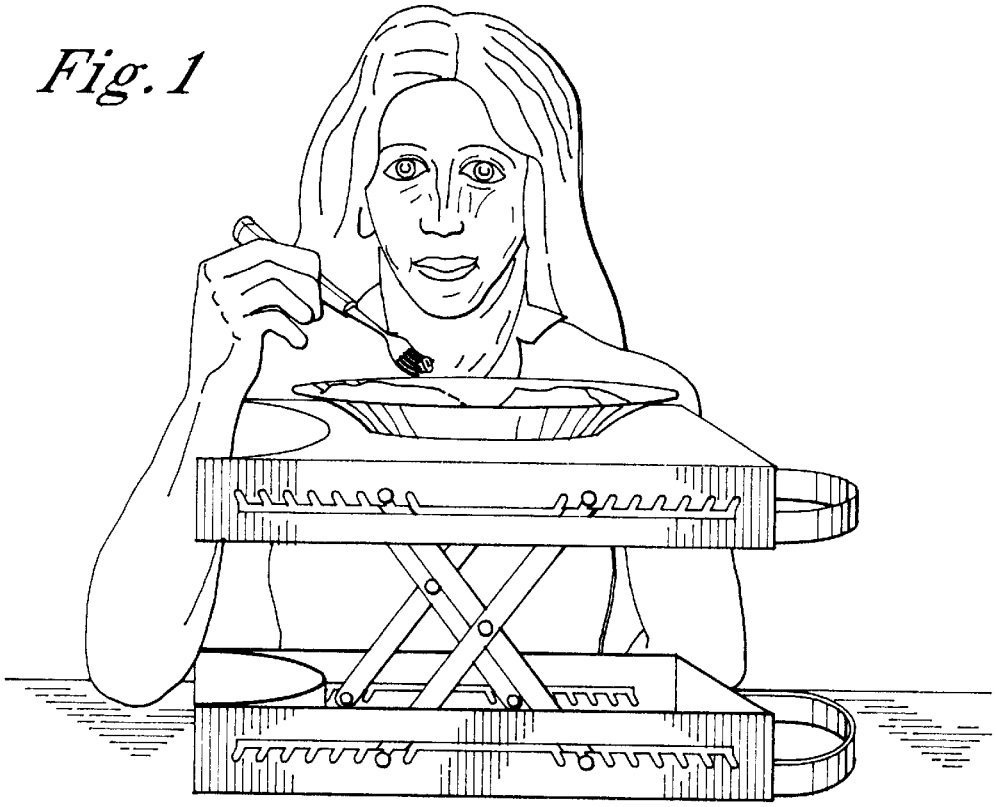
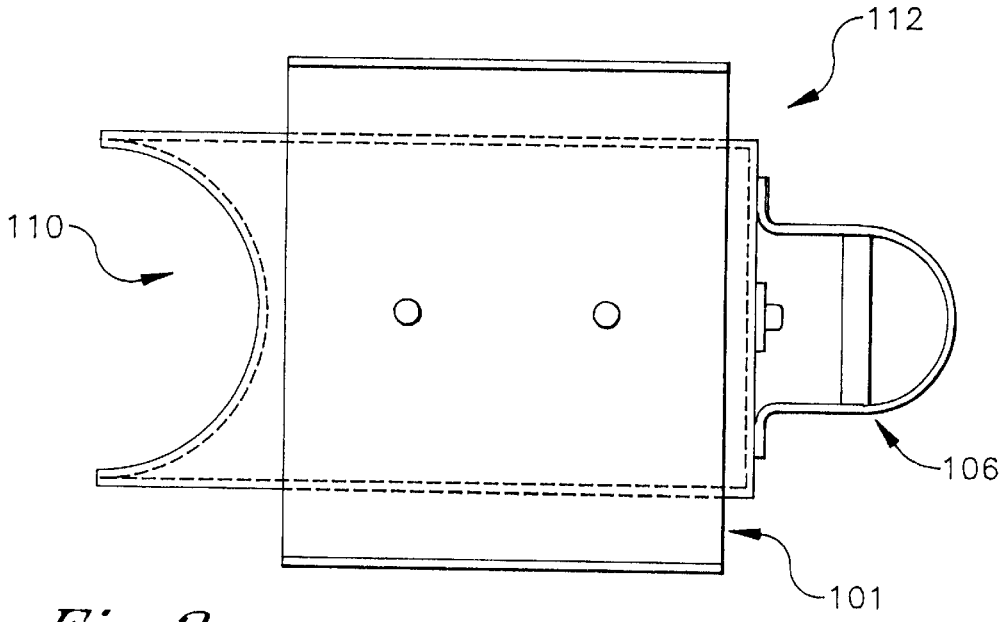
Fig. 2

ARM AND PLATE SUPPORT SELF-FEEDING DEVICE

BACKGROUND OF THE INVENTION

1. Field of the Invention

This invention is a device for use by handicapped persons who have trouble feeding themselves due to lack of muscle control or coordination in their arms and hands.

2. Brief Summary of the Prior Art

There are several known devices for aiding disabled persons in eating or in self-feeding. These devices propose fairly complicated mechanical devices that have many moving parts and components. These devices all possess more complicated features than does the present Invention.

Recently, Pat. No. 4,151,677 by Tucker (May 1, 1979) teaches an adjustable noisemaker with contact arms of varying length, thickness and width. Pat. No. 5,037,261 by Morewood (Aug. 6, 1991), for example, proposes a spoon support that fills the spoon from a plate below with a series of levers and wheels.

SUMMARY OF THE INVENTION

This eating and self-feeding mechanism is designed to be easy to use and portable. The present invention is particularly designed to aid persons who are relatively mobile and who have some difficulty eating by themselves, but can control their head position and can sit up at a table. This invention can be easily carried by a person in a large purse or bag and can be adjusted in height to fit any eating surface.

The present invention will be made out of light-weight plastic, will have a scissors-like height adjustment, an upper surface where a plate support can be placed, a cut-out where the eating arm can be supported, and a cup holder for a standard-sized cup.

The present invention has six (6) basic parts:

1. An upper portion where a plate support can be attached.
2. A plate support.
3. A scissors-like height adjustment mechanism.
4. A lower portion that rests on the eating surface.
5. a cup holder.
6. A clasp that will hold the upper and lower portions together This invention is superior to previous inventions because it is specifically designed for slightly handicapped persons who have most of their physical faculties. It is specifically designed to be easily portable, sturdy, and easy to set up by a physically challenged person.

An object of the present invention is to provide a portable eating aid device for partially handicapped persons.

Another object of this invention is to provide a low-cost eating aid.

Another object of the invention is to provide an easily adjustable device that can be manipulated by even physically challenged persons.

BRIEF DESCRIPTION OF THE DRAWINGS

The drawings provided can be understood by reading the accompanying description for one embodiment of the invention..

FIG. 1 is a side view of the invention showing how a person would sit and use it, holding a spoon and eating off of a plate on top of the device.

FIG. 2 is top view drawing of the device, assembled, showing the main features.

DESCRIPTION OF THE PREFERRED EMBODIMENT

Figure 3:
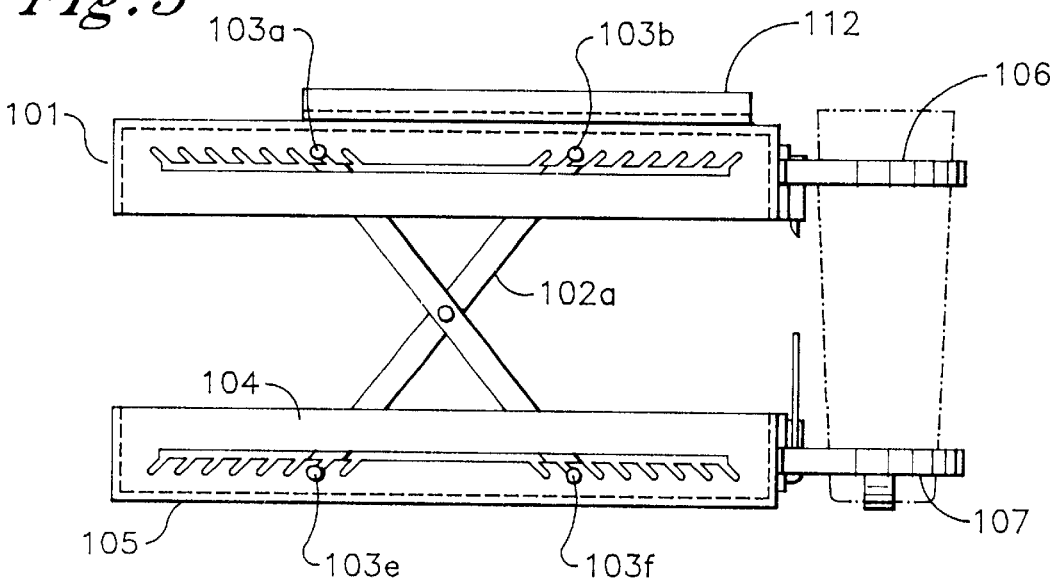
FIG. 3 is a side view drawing of the invention and its components, showing how a cup would be held.

Referring to FIG. 3, the upper portion of the device is indicated by 101 and the lower portion by 105. The upper and lower portions will be made of plastic to minimize cost and weight. Attached to the upper and lower portions are the scissors supports, 102*a* and 102*b*, made of metal or plastic, attached to the upper and lower portions at the indicated, movable positioning brads, 103*a*, 103*b*, 103*e*, and 103*f*. There are positioning brads attached to scissors support 102*b* identified by 103*c*, 103*d*, 103*g*, and 103*h*. The positioning brads are fixedly attached to the ends of the scissors supports, and the positioning brads can be moved to fit on the slide dimples, 104, as shown.

Figure 4:
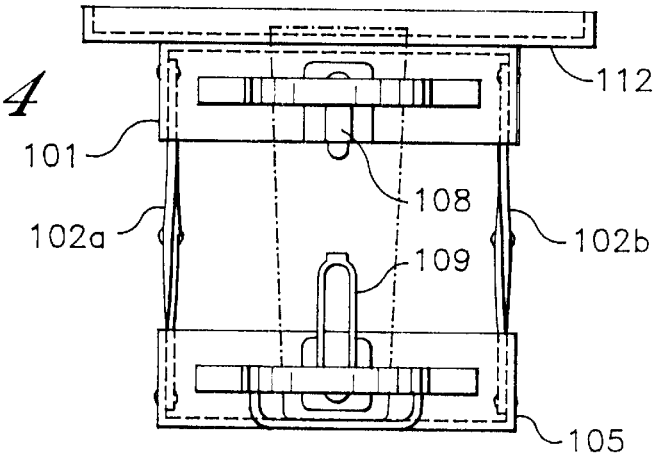
FIG. 4 is an end-on view from the cup holder end, showing the clasp.

This arrangement permits the distance between the upper and lower portion to be adjusted. Also in FIG. 3 and in FIG. 4, a cup support bracket upper portion, 106, and lower portion, 107, is fixedly attached to the respective upper and lower portions of the device. As in FIG. 4, locking mechanism upper and lower parts, 108 and 109, respectively, are fixedly attached to the respective upper and lower portions of the device, and can be latched when the upper and lower portions are brought together.

Figure 5:
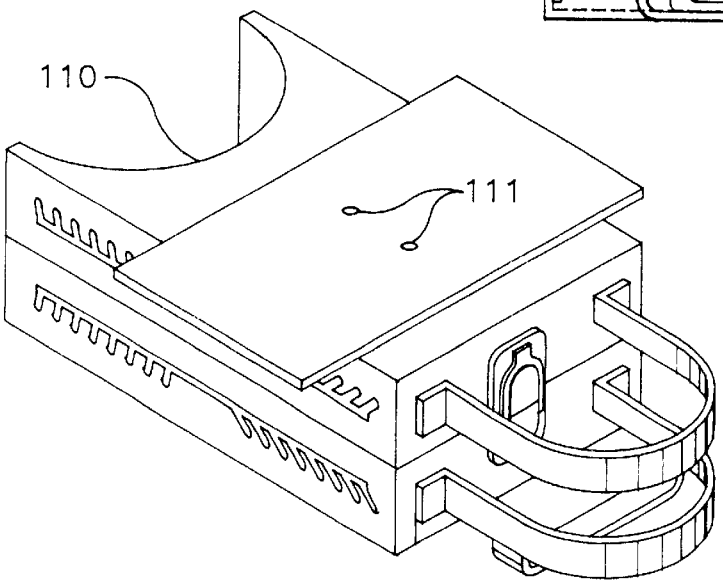
FIG. 5 is a perspective view showing the invention fully closed and the clasp locked.
Figure 6:
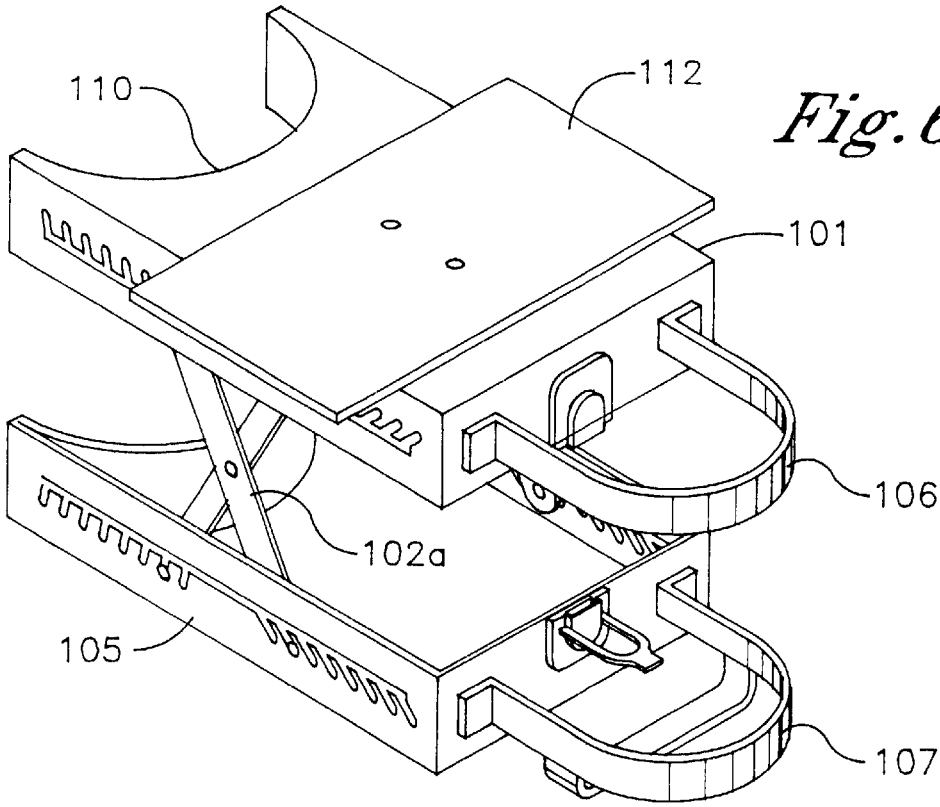
FIG. 6 is a perspective view showing the invention opened with the plate support attached to the top portion.
Figure 7:
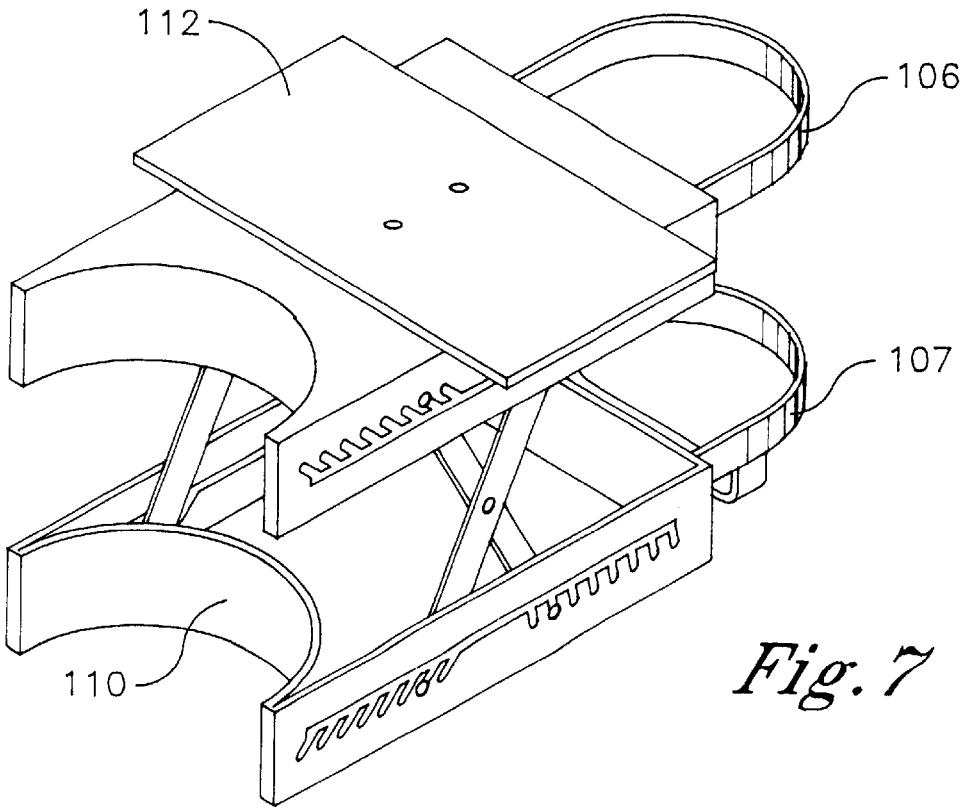
FIG. 7 is a perspective view from the other corner showing the arm support cut-out.

Perforating the upper portion of the device are two plate support holes, 111, as in FIG. 5. FIGS. 2, 6, and 7 show views of the invention with the plate support, 112, attached to the upper surface of the upper portion of the device. The attachment is made by snaps attached to the lower surface of the plate support, which snaps fit into the two plate support holes, 111.

The end of the device away from the cup holder and the locking mechanism is cut out in a semi-circular shape. This arm support indentation, 110, is designed to permit the eater to rest his/her eating arm in said indentation and steady it.

The above description was provided to illustrate and not limit this invention. Various modifications obvious to one skilled in the art are within the scope of the claims appended to this specification.

I claim:

1. A self-feeding device comprising an upper frame, a lower frame, an upper frame cut-out, a lower frame cut-out, two scissors supports, a cup holder upper portion, a cup holder lower portion, a locking bracket upper portion, and a locking bracket lower portion, said upper frame possessing two upper slide cuts on opposite sides of said upper frame, said upper slide cuts running the length of said upper frame and possessing a plurality of dimple cuts along their length, said lower frame possessing two lower slide cuts on opposite sides of said lower frame, said lower slide cuts running the length of said lower frame and possessing a plurality of dimple cuts along their length, said dimple cuts roughly semi-circular in shape and large enough to accept the diameter of positioning brads, each of the two scissor supports comprised of two scissor support arms, said scissor support arms of each scissors support connected rotatably to each other at the center of their lengths, said positioning brads attached fixedly to each end of each scissor support arm, said positioning brads introduced into the upper and lower slide cuts on each side of said upper and lower frames, one scissors support on each side of the device, said positioning brads the means by which said upper frame and said lower frame are positioned apart from each other, the procedure for which is to slide said positioning brads down said upper slide cuts and said lower slide cuts while simultaneously rotating said scissor support arms around the centers of their lengths, and having selected a desired separation distance between said upper frame and said lower frame, slide said positioning brads into the appropriate dimple cuts in each of said upper slide cuts and lower slide cuts, said upper frame possessing an upper frame cut-out placed on one end of said upper frame and capable of fitting to a human arm, said lower frame possessing a lower frame cut-out the same shape and on the same end of the device as said upper frame cut-out, a cup holder upper portion attached fixedly to said upper frame on the side of the device opposite said upper portion cut-out, a cup holder lower portion attached fixedly to said lower frame on the side of said device opposite to said lower portion cut-out, a locking bracket upper portion attached fixedly to said upper frame on the same side of said device as said cup holder upper portion, a locking bracket lower portion attached fixedly to said lower frame on the same side of said device as said cup holder lower portion, said locking bracket lower and upper portions positioned such that when said device is closed and said upper frame and lower frame are in contact, said locking bracket lower and upper portions can be locked to each other.

* * * * *